US012760524B2

(12) United States Patent
Utsunomiya et al.

(10) Patent No.: US 12,760,524 B2
(45) Date of Patent: Oct. 13, 2026

(54) EXTERIOR WALL STRUCTURE AND BUILDING INCLUDING EXTERIOR WALL STRUCTURE

(71) Applicant: Sekisui House, Ltd., Osaka (JP)

(72) Inventors: Shinji Utsunomiya, Osaka (JP); Hiroki Yamaguchi, Osaka (JP)

(73) Assignee: Sekisui House, Ltd., Osaka (JP)

( * ) Notice: Subject to any disclaimer, the term of this patent is extended or adjusted under 35 U.S.C. 154(b) by 184 days.

(21) Appl. No.: 18/564,327

(22) PCT Filed: May 2, 2023

(86) PCT No.: PCT/JP2023/017157
§ 371 (c)(1),
(2) Date: Nov. 27, 2023

(87) PCT Pub. No.: WO2024/228259
PCT Pub. Date: Nov. 7, 2024

(65) Prior Publication Data

US 2025/0075506 A1 Mar. 6, 2025

(51) Int. Cl.
*E04D 13/147* (2006.01)

(52) U.S. Cl.
CPC ..... *E04D 13/1478* (2013.01)

(58) Field of Classification Search
CPC ... E04D 13/14; E04D 13/1415; E04D 13/147; E04D 13/1473; E04D 13/1478; E04D 13/08; E04B 7/02; E04B 7/04
See application file for complete search history.

(56) References Cited

U.S. PATENT DOCUMENTS 3,994,104 A * 11/1976 Gurrola ..... E04D 3/30 52/22
2018/0245347 A1* 8/2018 Prygon ..... E04B 1/6803

FOREIGN PATENT DOCUMENTS

| | | | |
|---|---|---|---|
| JP | H04-238947 A | | 8/1992 |
| JP | H0874388 A | * | 3/1996 |
| JP | H09-88275 A | | 3/1997 |
| JP | 10-102695 A | | 4/1998 |
| JP | 2002167870 A | * | 6/2002 |
| JP | 2005282045 A | * | 10/2005 |
| JP | 2013060793 A | * | 4/2013 |
| JP | 2017172156 A | * | 9/2017 |
| JP | 2020183638 A | * | 11/2020 |

OTHER PUBLICATIONS

Machine Translation of JP2005282045 (Year: 2025).*

* cited by examiner

*Primary Examiner* — Christine T Cajilig
(74) *Attorney, Agent, or Firm* — Wolf, Greenfield & Sacks, P.C.

(57) ABSTRACT

An exterior wall structure of a building, the building including an exterior wall on which a lean-to roof is arranged. The exterior wall structure includes a column forming the exterior wall, a first backing attached to the column, a second backing attached to the column at a position located downward from the first backing, a cladding attached to the first backing, a lean-to roof frame member forming the lean-to roof, and a flashing member arranged between the cladding and the lean-to roof frame member. The first backing is attached to the column at a position located upward from the lean-to roof frame member. The second backing is attached to the column at a position located downward from the lean-to roof frame member.

6 Claims, 2 Drawing Sheets

EXTERIOR WALL STRUCTURE AND BUILDING INCLUDING EXTERIOR WALL STRUCTURE

CROSS REFERENCE TO RELATED APPLICATIONS

This Application is a national stage filing under 35 U.S.C. 371 of International Patent Application Serial No. PCT/JP2023/017157, filed May 2, 2023, entitled "EXTERIOR WALL STRUCTURE AND BUILDING INCLUDING EXTERIOR WALL STRUCTURE." The entire content of this application is incorporated herein by reference in its entirety.

TECHNICAL FIELD

The present disclosure relates to an exterior wall structure located near a lean-to roof and a building including an exterior wall structure.

BACKGROUND ART

Patent Literature 1 describes a known technique of an exterior wall structure located near a lean-to roof.

The building described in Patent Literature 1 shows the structure of an exterior wall in which a lean-to roof (roof of first floor in Patent Literature 1) intersects the exterior wall of the second floor. The exterior wall of the second floor includes a flashing member (flashing plate as described in Patent Literature 1). A cladding (exterior wall member in Patent Literature 1) is attached to a column or a stud with a waterproof sheet located in between. The flashing member is arranged near the lower end of the cladding.

CITATION LIST

Patent Literature

Patent Literature 1: Japanese Laid-Open Patent Publication No. 09-088275

SUMMARY OF INVENTION

Technical Problem

The exterior wall, which intersects the lean-to roof, includes a backing. The construction efficiency of an exterior wall structure including a backing can still be improved.

Solution to Problem (1) An exterior wall structure of a building, the building including an exterior wall on which a lean-to roof is arranged. The exterior wall structure includes a column forming the exterior wall, a first backing attached to the column, a second backing attached to the column at a position located downward from the first backing, a cladding attached to the first backing, a lean-to roof frame member forming the lean-to roof, and a flashing member arranged between the cladding and the lean-to roof frame member. The first backing is attached to the column at a position located upward from the lean-to roof frame member. The second backing is attached to the column at a position located downward from the lean-to roof frame member. This structure results in the exterior wall having a higher degree of construction freedom than when using the backing that extends along the column from the upper side to the lower side of the lean-to roof.

(2) The exterior wall structure according to (1), where the first backing is attached to the column in contact with an outer surface of the column. This structure simplifies installation of the first backing as compared with when the first backing is arranged between two columns.

(3) The exterior wall structure according to (1) or (2), where the flashing member includes a flashing upper portion extending in a vertical direction, a flashing intermediate portion extending from a lower end of the flashing upper portion, and a flashing lower portion extending from a lower end of the flashing intermediate portion. The flashing upper portion is located downward from a lower end surface of the first backing in the vertical direction. An outer surface of the flashing upper portion is flush with an outer surface of the first backing or located toward an indoor side of the outer surface of the first backing in a horizontal direction. The flashing lower portion is located above the lean-to roof. With this structure, the flashing upper portion receives more water from the first backing than when the outer surface of the flashing upper portion is located outward from the outer surface of the first backing. The flashing lower portion guides the water to the lean-to roof.

(4) The exterior wall structure according to (3), further including a boundary waterproof sheet laid out from the first backing to the lean-to roof frame member. The boundary waterproof sheet includes an upper portion located between the flashing upper portion and the column. When water enters the inner side of the flashing member, this structure restricts further advancement of the water toward the inner side of the column.

(5) The exterior wall structure according to any one of (1) to (4), further including a flashing support member supporting the flashing member. The flashing support member is fixed to the column at a position located downward from a lower end surface of the first backing. Thus, the exterior wall structure has a higher degree of construction freedom than when the flashing support member is arranged on the backing that extends along the column from the upper side to the lower side of the lean-to roof.

(6) A building, including the exterior wall structure according to any one of (1) to (5). This structure improves the degree of freedom when the building is constructed.

Advantageous Effects of Invention

The exterior wall structure and the building of the present disclosure improve the degree of construction freedom.

DESCRIPTION OF EMBODIMENTS

Building

A building 1 and an exterior wall structure 2 of the building 1 will now be described with reference to FIGS. 1 to 4. In the present embodiment, an outer side will refer to a position located toward the outdoor side from a subject in the horizontal direction. An inner side will refer to a position located toward the indoor side from a subject in the horizontal direction.

Figure 1:
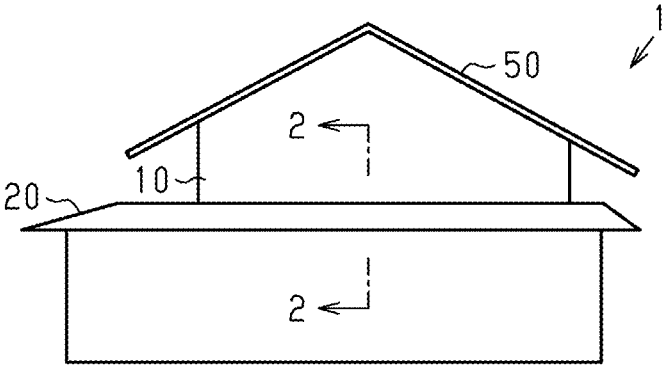
FIG. 1 is a schematic diagram of a building.
Figure 2:
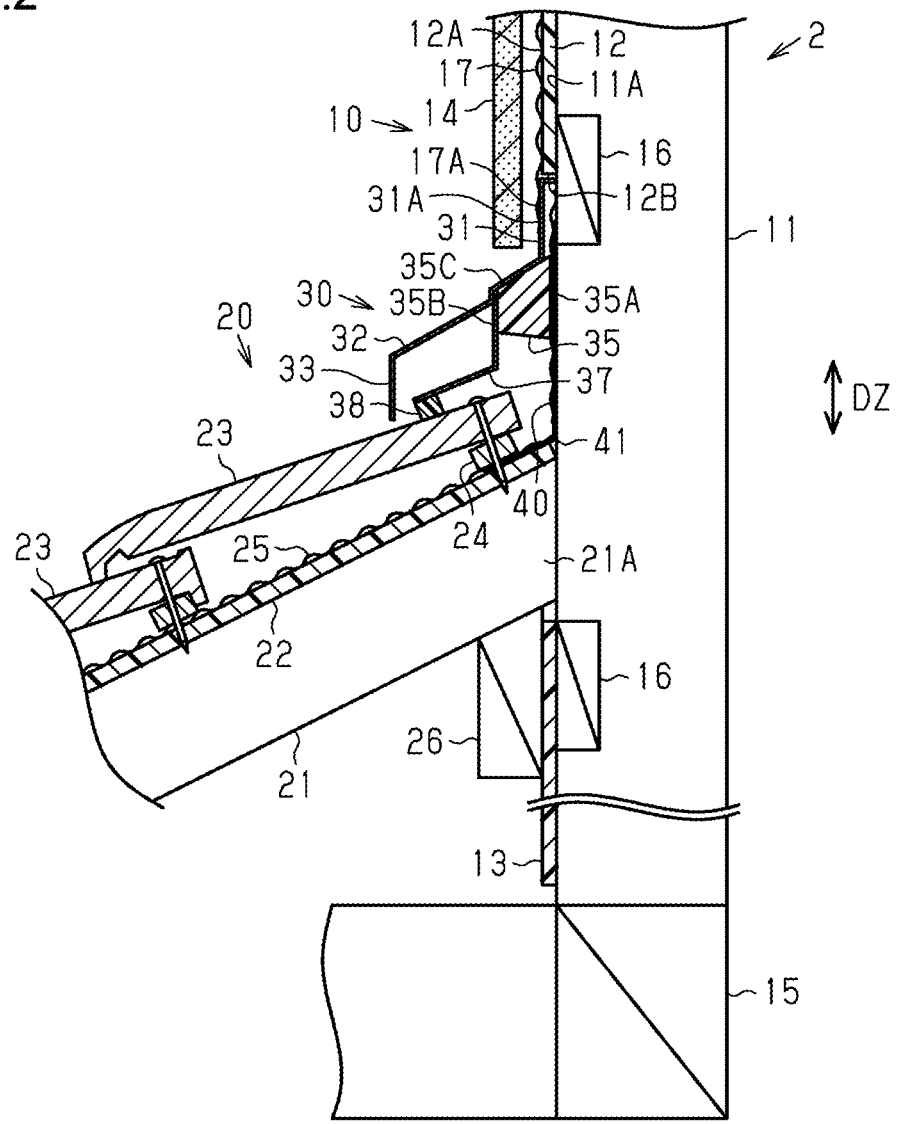
FIG. 2 is a cross-sectional view of an exterior wall structure taken along line 2-2 in FIG. 1.

As shown in FIG. 1, the building 1 includes an exterior wall 10 and a lean-to roof 20. In the present embodiment, the building 1 further includes a roof 50. In the building 1 of the present embodiment, the lean-to roof 20 is arranged on the exterior wall 10.

The roof 50 covers over the indoor space of the building 1. The lean-to roof 20 is arranged at an intermediate portion of the exterior wall 10 in a vertical direction DZ. The lean-to roof 20 may be inclined. Specifically, the lean-to roof 20 is sloped downwardly and outwardly from the exterior wall 10. The lean-to roof 20 may extend horizontally. The lean-to roof 20 may form the roof of an entrance porch. The lean-to roof 20 may form the roof of a deck. The lean-to roof 20 may form an eaves arranged over a window or door. The lean-to roof 20 may form the roof of a first-floor portion of the building 1. The first-floor portion refers to a portion of the first floor that is lower than the second floor of the building 1.

The building 1 includes an exterior wall structure 2 near the lean-to roof 20. The exterior wall structure 2 in the present embodiment is the structure of the exterior wall 10 where the lean-to roof 20 intersects. The structure of the exterior wall 10 of the second floor where the lean-to roof 20 intersects will now be described as an example of the exterior wall structure 2.

Exterior Wall Structure

The exterior wall structure 2 includes a column 11 forming the exterior wall 10, a first backing 12 attached to the column 11, and a second backing 13 attached to the column 11 at a position located downward from the first backing 12. The exterior wall structure 2 further includes a cladding 14, which is attached to the first backing 12, and a lean-to roof frame member 21, which forms the lean-to roof 20. The exterior wall structure 2 further includes a flashing member 30 arranged between the cladding 14 and the lean-to roof frame member 21. The exterior wall structure 2 further includes a flashing support member 35.

The column 11 includes main columns forming the framework structure of the building 1 and studs arranged between the main columns. The main columns and the studs are formed from wood. The studs are thinner than the main columns. Each main column may be a continuous column extending from the first floor to the second floor of the building 1. The main column may be a column vertically extending from a horizontal member 15 that is arranged at an intermediate portion of the building 1 in the vertical direction DZ. In the present embodiment, the upper end of the column 11 extends to the roof 50 that covers the second floor. The lower end of the column 11 extends to the horizontal member 15. The lower end of the column 11 is located downward from an inner end 21A of the lean-to roof frame member 21.

Two adjacent columns 11 may be coupled by a horizontally extending column connection member 16. The column connection member 16 is arranged inward from an outer surface 11A of the column 11. The column connection member 16 is arranged between the side surfaces of the two columns 11. In another example, the column connection member 16 extends through multiple columns 11.

Lean-to Roof

The lean-to roof 20 includes the lean-to roof frame member 21, a lean-to roof backing 22 (also referred to as sheathing board) arranged on the lean-to roof frame member 21, and roof members 23 arranged on the lean-to roof backing 22. Each roof member 23 includes a metal roof member, a ceramic roof member, and a concrete roof member. When the lean-to roof 20 extends horizontally, the roof member 23 includes asphalt and concrete. In the present embodiment, roof members 23 are arranged so that the lower end of a roof member 23 is set on the upper end of another roof member 23. The upper portion of each roof member 23 is set on a positioning member 24 (also referred to as batten). The upper portion of the roof member 23 is fastened with nails to the lean-to roof backing 22 with the positioning member 24. A roof waterproof sheet 25 is laid out on the surface of the lean-to roof backing 22.

The lean-to roof frame member 21 includes a sloping beam and a rafter. The sloping beam and the rafter are formed by a wood or metal member. Further, the lean-to roof frame member 21 includes a horizontal member extending horizontally. The horizontal member is formed by a wood or metal member.

The lean-to roof frame member 21 includes the inner end 21A located near the column 11. The inner end 21A of the lean-to roof frame member 21 is set on a frame support member 26 and fixed to the frame support member 26 by a coupling member. The coupling member includes a bolt, a nail, a rivet, and a coupling fixture.

The frame support member 26 extends horizontally. The frame support member 26 extends across multiple columns 11. The frame support member 26 is attached to each column 11 with the second backing 13. The frame support member 26 is fastened with nails to the column 11. The frame support member 26 is fixed to the column 11 at a position located downward from the inner end 21A of the lean-to roof frame member 21.

First Backing, Second Backing, and Cladding

The first backing 12 is formed by a wooden plate. The first backing 12 is attached to the column 11 at a position located upward from the lean-to roof frame member 21. The first backing 12 is attached to the column 11 in contact with the outer surface 11A of the column 11. The first backing 12 extends across multiple columns 11. The first backing 12 is fastened with nails to the columns 11.

A wall waterproof sheet 17 is attached to an outer surface 12A of the first backing 12. The wall waterproof sheet 17 includes a lower end 17A that covers an outer surface 31A of a flashing upper portion 31 of the flashing member 30. The lower end 17A of the wall waterproof sheet 17 is fixed to the flashing upper portion 31 of the flashing member 30 by an adhesive or an adhesive member.

The cladding 14 is attached to the outer side of the first backing 12. The cladding 14 is attached to the first backing 12 by a horizontal member (not shown) extending horizontally. The horizontal member is also referred to as a furring strip. The horizontal member is attached to the first backing 12 with the wall waterproof sheet 17 located in between. The horizontal member is formed from wood. The cladding 14 includes metal siding, ceramic siding, wood siding, concrete siding, and resin siding.

The second backing 13 is formed by a wooden plate. The second backing 13 is attached to the column 11 at a position located downward from the lean-to roof frame member 21. The second backing 13 is attached to the column 11 in contact with the outer surface 11A of the column 11. The second backing 13 extends across multiple columns 11. The second backing 13 is fastened with nails to the columns 11.

The second backing 13 is located downward from the lean-to roof 20 and inward from the exterior wall 10. Thus, the cladding 14 is not attached to the second backing 13. The second backing 13 reinforces the exterior wall 10. Specifically, the second backing 13 extends across multiple columns 11 to reinforce the exterior wall 10.

The columns 11 are coupled to one another by the first backing 12, which is located upward from the lean-to roof frame member 21, and coupled to one another by the second backing 13, which is located downward from the lean-to roof frame member 21. This structure increases the strength of the exterior wall 10.

Flashing Member

The flashing member 30 is formed by a resin or metal plate. The flashing member 30 includes a flashing upper portion 31 extending in the vertical direction DZ, a flashing intermediate portion 32 extending from the lower end of the flashing upper portion 31, and a flashing lower portion 33 extending from the lower end of the flashing intermediate portion 32. The flashing intermediate portion 32, which extends from the lower end of the flashing upper portion 31, is inclined. The flashing lower portion 33 extends downward from the lower end of the flashing intermediate portion 32. The flashing member 30 is arranged near the lower end of the cladding 14 as described above.

The flashing member 30 is supported by the flashing support member 35. The flashing intermediate portion 32 of the flashing member 30 is partially fixed to the flashing support member 35. When the flashing member 30 is supported by the flashing support member 35, the portions of the flashing member 30 are arranged as follows. The flashing upper portion 31 is located downward from a lower end surface 12B of the first backing 12 in the vertical direction DZ. The outer surface 31A of the flashing upper portion 31 is flush with the outer surface 12A of the first backing 12 or located toward the indoor side of the outer surface 12A of the first backing 12 in the horizontal direction. The flashing lower portion 33 is located above the lean-to roof 20. Specifically, the flashing lower portion 33 is arranged on the one of the roof members 23 of the lean-to roof 20 that is the closest to the exterior wall 10. The flashing intermediate portion 32 is inclined in the same manner as the roof member 23 when the flashing member 30 is attached to the exterior wall 10.

The exterior wall structure 2 may include a waterproof member 37. The waterproof member 37 is located inward from the flashing member 30. The waterproof member 37 extends from the flashing support member 35 to the roof member 23. The waterproof member 37 is formed by a resin or metal plate. The upper end of the waterproof member 37 is fixed to the flashing support member 35. The lower end of the flashing support member 35 is fixed to the roof member 23 by a sealing material 38.

The flashing support member 35 supports the flashing member 30 and the waterproof member 37. The flashing support member 35 is fixed to the column 11 at a position located downward from the lower end surface 12B of the first backing 12 and upward from the lean-to roof backing 22. The flashing support member 35 includes a first side surface 35A contacting the column 11, a second side surface 35B to which the waterproof member 37 is attached, and an upper surface 35C on which the flashing member 30 is set.

Boundary Waterproof Sheet

The exterior wall structure 2 further includes a boundary waterproof sheet 40 laid out from the lower end of the first backing 12 to the lean-to roof frame member 21. The boundary waterproof sheet 40 includes an upper portion located between the flashing upper portion 31 and the column 11.

The boundary waterproof sheet 40 may be guided by an auxiliary panel 41. The auxiliary panel 41 is attached to the column 11 and the lean-to roof frame member 21 to extend from the lower end of the first backing 12 to the lean-to roof frame member 21. The auxiliary panel 41 is made from metal or resin. The boundary waterproof sheet 40 is laid out along the outer surface of the auxiliary panel 41.

Operation of Present Embodiment

The operation of the present embodiment will now be described with reference to FIGS. 3 and 4.

Figure 3:
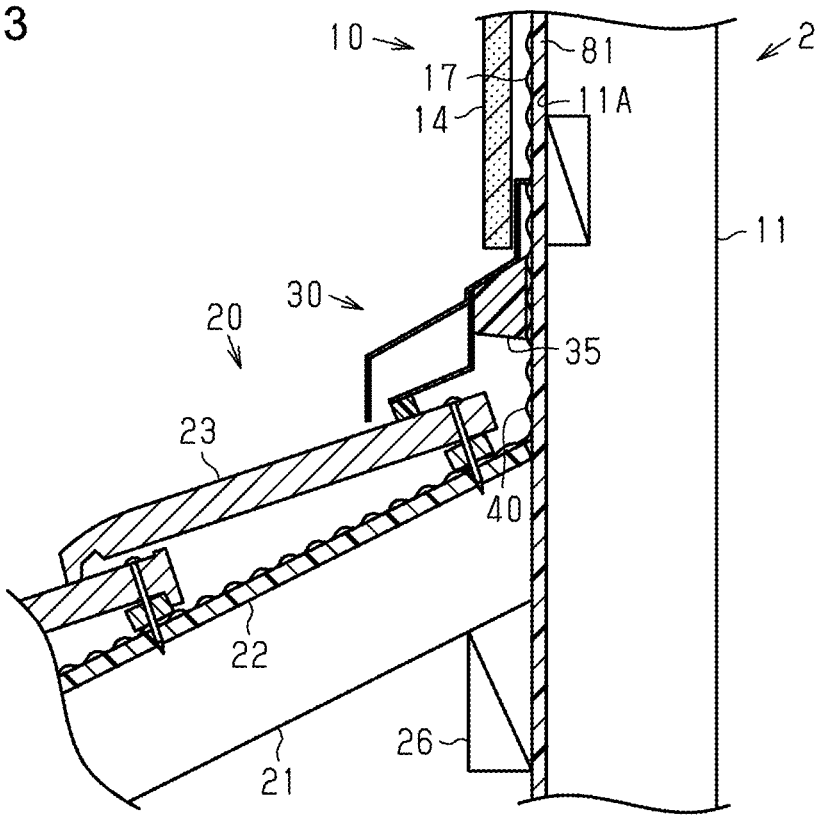
FIG. 3 is a cross-sectional view of the exterior wall structure showing an exterior wall of a first referential example.

FIG. 3 shows the exterior wall structure 2 of a first referential example. In this example, a backing 81 is arranged on the outer surface 11A of the column 11. The backing 81 extends from a position located upward from the lean-to roof 20 to a position located downward from the lean-to roof 20 in the vertical direction DZ. In such an exterior wall structure 2, the lean-to roof frame member 21 and the frame support member 26 cannot be attached unless the backing 81 is attached to the column 11. Thus, the lean-to roof 20 is installed after attachment of the backing 81.

Figure 4:
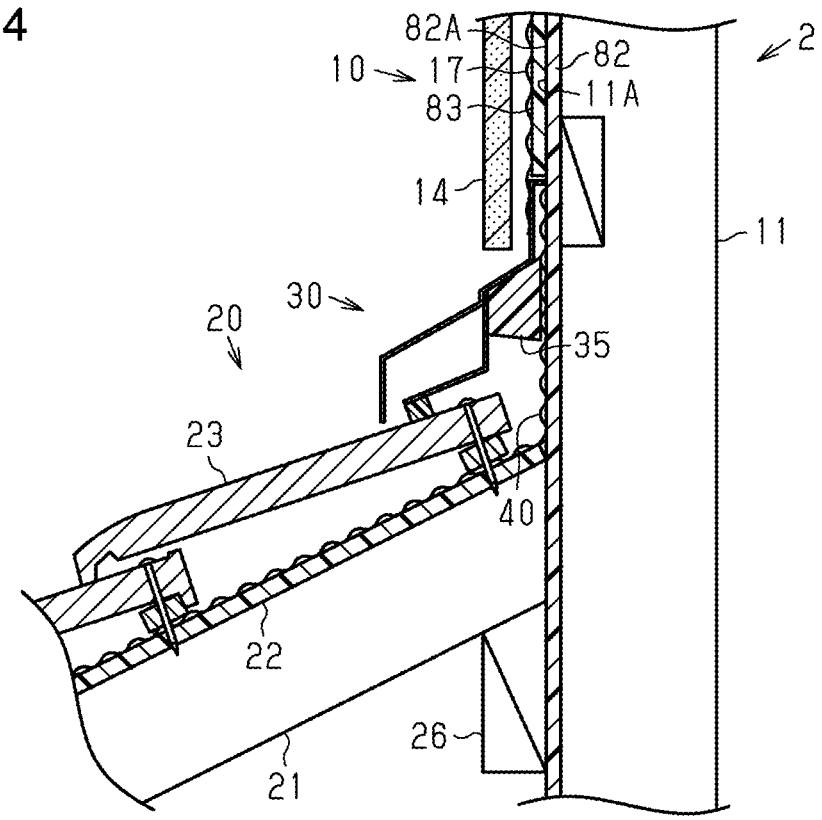
FIG. 4 is a cross-sectional view of the exterior wall structure showing an exterior wall of a second referential example.

FIG. 4 shows the exterior wall structure 2 of a second referential example. In this example, a backing 82 is arranged between two columns 11. Specifically, the backing 82 is attached between two columns 11 so that an outer surface 82A of the backing 82 is flush with the outer surface 11A of the column 11. The backing 82 extends from a position located upward from the lean-to roof 20 to a position located downward from the lean-to roof 20 in the vertical direction DZ. Further, an additional backing 83 is attached to the backing 82 at a position located upward from the lean-to roof 20. The frame support member 26 is fixed to the column 11. In such an exterior wall structure 2, attachment of the lean-to roof frame member 21 can be performed before the backing 82 is attached to the column 11. However, the attachment of the backing 82 has to be performed between two columns 11 and is thus cumbersome.

In the present embodiment, the first backing 12 and the second backing 13 are separately attached to the outer surface 11A of the column 11. The frame support member 26 is fixed to the column 11 with the second backing 13 located in between at a position located downward from the first backing 12. With this structure, the frame support member 26 can be attached to the column 11 before attachment of the first backing 12. Thus, the lean-to roof 20 can be installed on the column 11 regardless of the installation state of the first backing 12.

Advantages of Embodiment (1) The exterior wall structure 2 includes the column 11, the first backing 12, the second backing 13, the cladding 14 attached to the first backing 12, the lean-to roof frame member 21, and the flashing member 30. The first backing 12 is attached to the column 11 at a position located upward from the lean-to roof frame member 21. The second backing 13 is attached to the column 11 at a position located downward from the lean-to roof frame member 21. This structure results in the exterior wall structure 2 having a higher degree of construction freedom than when using the backing 81 or 82 that extends along the column 11 from the upper side to the lower side of the lean-to roof 20.

(2) The first backing 12 is attached to the column 11 in contact with the outer surface 11A of the column 11. This structure simplifies installation of the first backing 12 as compared with when the first backing 12 is arranged between two columns 11.

(3) The flashing member 30 includes the flashing upper portion 31, the flashing intermediate portion 32, and the flashing lower portion 33. The flashing upper portion 31 is located downward from the lower end surface 12B of the first backing 12 in the vertical direction DZ. The outer surface 31A of the flashing upper portion 31 is flush with the outer surface 12A of the first backing 12 or located toward the indoor side of the outer surface 12A of the first backing 12 in the horizontal direction. The flashing lower portion 33 is located above the lean-to roof 20. With this structure, the flashing upper portion 31 receives more water from the first backing 12 than when the outer surface 31A of the flashing upper portion 31 is located outward from the outer surface 12A of the first backing 12. The flashing lower portion 33 guides the water to the lean-to roof 20.

(4) The exterior wall structure 2 includes the boundary waterproof sheet 40. The boundary waterproof sheet 40 extends from the first backing 12 to the lean-to roof frame member 21. The upper portion of the boundary waterproof sheet 40 is located between the flashing upper portion 31 and the column 11. When water enters the inner side of the flashing member 30, this structure restricts further advancement of the water toward the inner side of the column 11.

(5) The exterior wall structure 2 includes the flashing support member 35 that supports the flashing member 30. The flashing support member 35 is fixed to the column 11 at a position located downward from the lower end surface 12B of the first backing 12. Thus, the exterior wall structure 2 has a higher degree of construction freedom than when the flashing support member 35 is arranged on the backing 81 that extends along the column 11 from the upper side to the lower side of the lean-to roof 20. For example, the flashing support member 35 can be attached to the column 11 after the first backing 12 is attached to the column 11. Alternatively, the first backing 12 can be attached to the column 11 after the flashing support member 35 is attached to the column 11.

(6) The building 1 includes the exterior wall structure 2 having one of advantages (1) to (5). This structure improves the degree of freedom when the building 1 is constructed.

Modifications

The above-described embodiment exemplifies, without any intention to limit, applicable forms of the building 1 and the exterior wall structure 2. The building 1 and the exterior wall structure 2 in the above embodiment may have a different form. For example, the configuration in the above embodiment may be replaced, changed, or omitted in part or include an additional element. Modifications of the embodiment will now be described.

(1) In the embodiment, the lean-to roof frame member 21 is fixed to the frame support member 26. Instead, the lean-to roof frame member 21 may be directly fixed to the column 11.

(2) In the embodiment, the lean-to roof 20 is sloped downwardly and outwardly from the exterior wall 10. Instead, the lean-to roof 20 may include a first inclined portion that is sloped downwardly to the left and a second inclined portion that is sloped downwardly to the right in front view.

(3) In the embodiment, the first backing 12 and the second backing 13 are arranged on the outer surface 11A of the column 11. Instead, one of the first backing 12 and the second backing 13 may be arranged between the columns 11. Further, the first backing 12 and the second backing 13 may each be arranged between the columns 11. This will result in advantage (1).

(4) In the embodiment, the frame support member 26 is attached to the column 11 with the second backing 13 located in between. Instead, the frame support member 26 may be directly attached to the column 11. In this case, the second backing 13 is fixed to the column 11 at a position located downward from the frame support member 26.

The present specification discloses the following techniques.

Clause 1

An exterior wall structure of a building, the building including an exterior wall on which a lean-to roof is arranged, the exterior wall structure including:

a column forming the exterior wall;

a first backing attached to the column;

a second backing attached to the column at a position located downward from the first backing;

a cladding attached to the first backing;

a lean-to roof frame member forming the lean-to roof; and a flashing member arranged between the cladding and the lean-to roof frame member, where the first backing is attached to the column at a position located upward from the lean-to roof frame member, and the second backing is attached to the column at a position located downward from the lean-to roof frame member.

Clause 2

The exterior wall structure according to clause 1, where the first backing is attached to the column in contact with an outer surface of the column.

Clause 3

The exterior wall structure according to clause 1, where the flashing member includes a flashing upper portion extending in a vertical direction, a flashing intermediate portion extending from a lower end of the flashing upper portion, and a flashing lower portion extending from a lower end of the flashing intermediate portion, the flashing upper portion is located downward from a lower end surface of the first backing in the vertical direction, an outer surface of the flashing upper portion is flush with an outer surface of the first backing or located toward an indoor side of the outer surface of the first backing in a horizontal direction, and the flashing lower portion is located above the lean-to roof.

Clause 4

The exterior wall structure according to clause 3, further including:

a boundary waterproof sheet laid out from the first backing to the lean-to roof frame member, where the boundary waterproof sheet includes an upper portion located between the flashing upper portion and the column.

Clause 5

The exterior wall structure according to clause 1, further including:

a flashing support member supporting the flashing member, where the flashing support member is fixed to the column at a position located downward from a lower end surface of the first backing.

Clause 6

A building, including:

the exterior wall structure according to any one of clauses 1 to 5.

REFERENCE SIGNS LIST

DZ) vertical direction, 1) building, 2) exterior wall structure, 10) exterior wall, 11) column, 11A) outer surface, 12) first backing, 12A) outer surface, 13) second backing, 14) cladding, 20) lean-to roof, 21) lean-to roof frame member, 30) flashing member, 31) flashing upper portion, 31A) outer surface, 32) flashing intermediate portion, 33) flashing lower portion, 35) flashing support member, 40) boundary waterproof sheet, 82A) outer surface

The invention claimed is:

1. An exterior wall structure of a building, the building including an exterior wall on which a lean-to roof is arranged, the exterior wall structure comprising:

a column of a plurality of columns forming the exterior wall, the plurality of columns including main columns forming a framework structure of the building and studs arranged between the main columns;

a first backing attached to the column;

a second backing attached to the column at a position located downward from the first backing;

a cladding attached only to the first backing and not attached to the second backing;

a lean-to roof frame member forming the lean-to roof; and a flashing member arranged between the cladding and the lean-to roof frame member, wherein the first backing is attached to the column at a position located upward from the lean-to roof frame member, and the second backing is attached to the column at a position located downward from the lean-to roof frame member.

2. The exterior wall structure according to claim 1, wherein the first backing is attached to the column in contact with an outer surface of the column.

3. The exterior wall structure according to claim 1, wherein the flashing member includes a flashing upper portion extending in a vertical direction, a flashing intermediate portion extending from a lower end of the flashing upper portion, and a flashing lower portion extending from a lower end of the flashing intermediate portion, the flashing upper portion is located downward from a lower end surface of the first backing in the vertical direction, an outer surface of the flashing upper portion is flush with an outer surface of the first backing or located toward an indoor side of the outer surface of the first backing in a horizontal direction, and the flashing lower portion is located above the lean-to roof.

4. The exterior wall structure according to claim 3, further comprising:

a boundary waterproof sheet laid out from the first backing to the lean-to roof frame member, wherein the boundary waterproof sheet includes an upper portion located between the flashing upper portion and the column.

5. The exterior wall structure according to claim 1, further comprising:

a flashing support member supporting the flashing member, wherein the flashing support member is fixed to the column at a position located downward from a lower end surface of the first backing.

6. A building, comprising:

the exterior wall structure according to claim 1.

* * * * *